US011384714B2

(12) United States Patent
Kashima et al.

(10) Patent No.: US 11,384,714 B2
(45) Date of Patent: Jul. 12, 2022

(54) AUTO-CHOKE DEVICE OF CARBURETOR

(71) Applicant: HONDA MOTOR CO., LTD., Tokyo (JP)

(72) Inventors: Soji Kashima, Saitama (JP); Ryota Morinaga, Saitama (JP); Keigo Yoshida, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/043,922

(22) PCT Filed: Mar. 30, 2018

(86) PCT No.: PCT/JP2018/013859
§ 371 (c)(1),
(2) Date: Sep. 30, 2020

(87) PCT Pub. No.: WO2019/187097
PCT Pub. Date: Oct. 3, 2019

(65) Prior Publication Data

US 2021/0017937 A1 Jan. 21, 2021

(51) Int. Cl.
*F02M 1/10* (2006.01)

(52) U.S. Cl.
CPC ..... *F02M 1/10* (2013.01)

(58) Field of Classification Search
CPC ..... F02M 1/10
USPC ..... 261/39.2
See application file for complete search history.

(56) References Cited

U.S. PATENT DOCUMENTS 4,730,592 A 3/1988 Uozumi et al.
4,788,014 A 11/1988 Kanno
7,854,216 B2 * 12/2010 Kasai ..... F02M 35/1017 123/336
7,886,716 B1 * 2/2011 Arai ..... F02M 1/02 123/400

(Continued)

FOREIGN PATENT DOCUMENTS

CN 1821568 A 8/2006
CN 1829857 A 9/2006

(Continued)

OTHER PUBLICATIONS

May 22, 2018, International Search Report issued for related PCT application No. PCT/JP2018/013859.

(Continued)

*Primary Examiner* — Charles S Bushey
(74) *Attorney, Agent, or Firm* — Paratus Law Group, PLLC

(57) ABSTRACT

An automatic choke device of a carburetor includes a wax attached to an engine main body, a rod configured to perform a linear motion in conjunction with expansion of the wax, a choke lever configured to rotate in conjunction with the linear motion of the rod, and a choke shaft arranged so as to be able to abut against the choke lever and connected to a choke valve of the carburetor. The choke lever includes a flat portion that engages with an engaging portion of the choke shaft, and a circular arc portion that is formed in a circular arc shape so as to be continuous from the flat portion and is brought into sliding contact with the engaging portion of the choke shaft.

6 Claims, 9 Drawing Sheets

(56) References Cited

U.S. PATENT DOCUMENTS

| | | | | |
|---|---|---|---|---|
| 7,950,366 | B2 * | 5/2011 | Arai | F02D 41/067 123/376 |
| 2005/0022798 | A1 | 2/2005 | Roth et al. | |
| 2006/0022359 | A1 | 2/2006 | Edamatsu et al. | |
| 2006/0065224 | A1 | 3/2006 | Pattullo | |
| 2006/0070594 | A1 | 4/2006 | Pattullo | |
| 2006/0180113 | A1 | 8/2006 | Pattullo | |
| 2006/0208371 | A1 | 9/2006 | Suzuki et al. | |
| 2007/0251484 | A1 | 11/2007 | Pattullo | |
| 2008/0029377 | A1 | 2/2008 | Tsuduki | |
| 2008/0121201 | A1 | 5/2008 | King et al. | |
| 2008/0223336 | A1 | 9/2008 | Arai et al. | |
| 2010/0237516 | A1 | 9/2010 | Kern et al. | |

FOREIGN PATENT DOCUMENTS

| | | | |
|---|---|---|---|
| CN | 101245746 | A | 8/2008 |
| CN | 101839190 | A | 9/2010 |
| JP | S55-119930 | A | 9/1980 |
| JP | S57-200651 | A | 12/1982 |
| JP | S58-044257 | A | 3/1983 |
| JP | S62-051744 | A | 3/1987 |
| JP | S63-189661 | A | 8/1988 |
| JP | 2006-037804 | A | 2/2006 |

OTHER PUBLICATIONS

May 22, 2018, International Search Opinion issued for related PCT application No. PCT/JP2018/013859.

May 18, 2021, Japanese Office Action issued for related JP application No. 2020-508866.

Jan. 25, 2021, European Search Report issued for related EP application No. 18913168.3.

Sep. 27, 2021, Chinese Office Action issued for related CN application No. 201880091980.7.

* cited by examiner 25
31
43
45
45c
45d
47
47d
22

AUTO-CHOKE DEVICE OF CARBURETOR

CROSS REFERENCE TO PRIOR APPLICATION

This application is a National Stage patent application of PCT International Patent Application No. PCT/JP2018/013859 (filed on Mar. 30, 2018) under 35 U.S.C. § 371, which is hereby incorporated by reference in its entirety.

TECHNICAL FIELD

The present invention relates to an automatic choke device of a carburetor provided in an engine.

BACKGROUND ART

There has been known an automatic choke device that automatically opens and closes a choke valve of a carburetor in accordance with a temperature of an engine main body, thereby facilitating starting of an engine, particularly, starting at a low temperature. For example, an automatic choke device described in Patent Document 1 includes a wax that is attached to an engine main body, a rod that performs a linear motion in conjunction with thermal expansion of the wax, a choke lever that rotates in conjunction with the linear motion of the rod, and a choke shaft that is arranged so as to be able to abut against the choke lever and connected to a choke valve of a carburetor. In this type of automatic choke device, since the wax continues to be thermally expanded (hereinafter, referred to as "overstroke of wax" as appropriate) even after the choke valve is fully opened, it is necessary to absorb the overstroke of the wax.

RELATED ART REFERENCE

Patent Document

Patent Document 1: JP-A-2006-037804

SUMMARY OF INVENTION

Technical Problem

However, in the automatic choke device described in Patent Document 1, since the choke lever includes two lever members that can be individually rotated, and a connecting spring that connects the two lever members, and the overstroke of the wax is absorbed by expansion of the connecting spring, the number of components increases, and an excessive stress acts on a support portion of the connecting spring, so that it is necessary to increase rigidity of the lever member or the like.

The present invention provides an automatic choke device of a carburetor that can suppress the number of components and appropriately absorb overstroke of a wax.

Solution to Problem

According to the present invention, there is provided an automatic choke device of a carburetor including:

a wax attached to an engine main body;

a rod configured to perform a linear motion in conjunction with expansion of the wax;

a choke lever configured to rotate in conjunction with the linear motion of the rod; and a choke shaft arranged so as to be able to abut against the choke lever and connected to a choke valve of the carburetor, wherein the choke lever includes a flat portion that engages with an engaging portion of the choke shaft, and a circular arc portion that is formed in a circular arc shape so as to be continuous from the flat portion and is brought into sliding contact with the engaging portion of the choke shaft.

Advantageous Effects of Invention

According to the present invention, it is possible to provide the automatic choke device for a carburetor that can suppress the number of components and appropriately absorb the overstroke of the wax.

BRIEF DESCRIPTION OF DRAWINGS

FIGS. 9A, 9B, 9C, 9D, and 9E are explanatory views showing an operation of the automatic choke device, in which FIG. 9A is an explanatory view showing a state when the engine is stopped (cold state), FIG. 9B is an explanatory view showing a state immediately after the engine is started, FIG. 9C is an explanatory view showing a state when the engine is warming up, FIG. 9D is an explanatory view showing a state in which a choke valve is fully opened, and FIG. 9E is an explanatory view showing an overstroke state of a wax.

DESCRIPTION OF EMBODIMENTS

Figure 1:
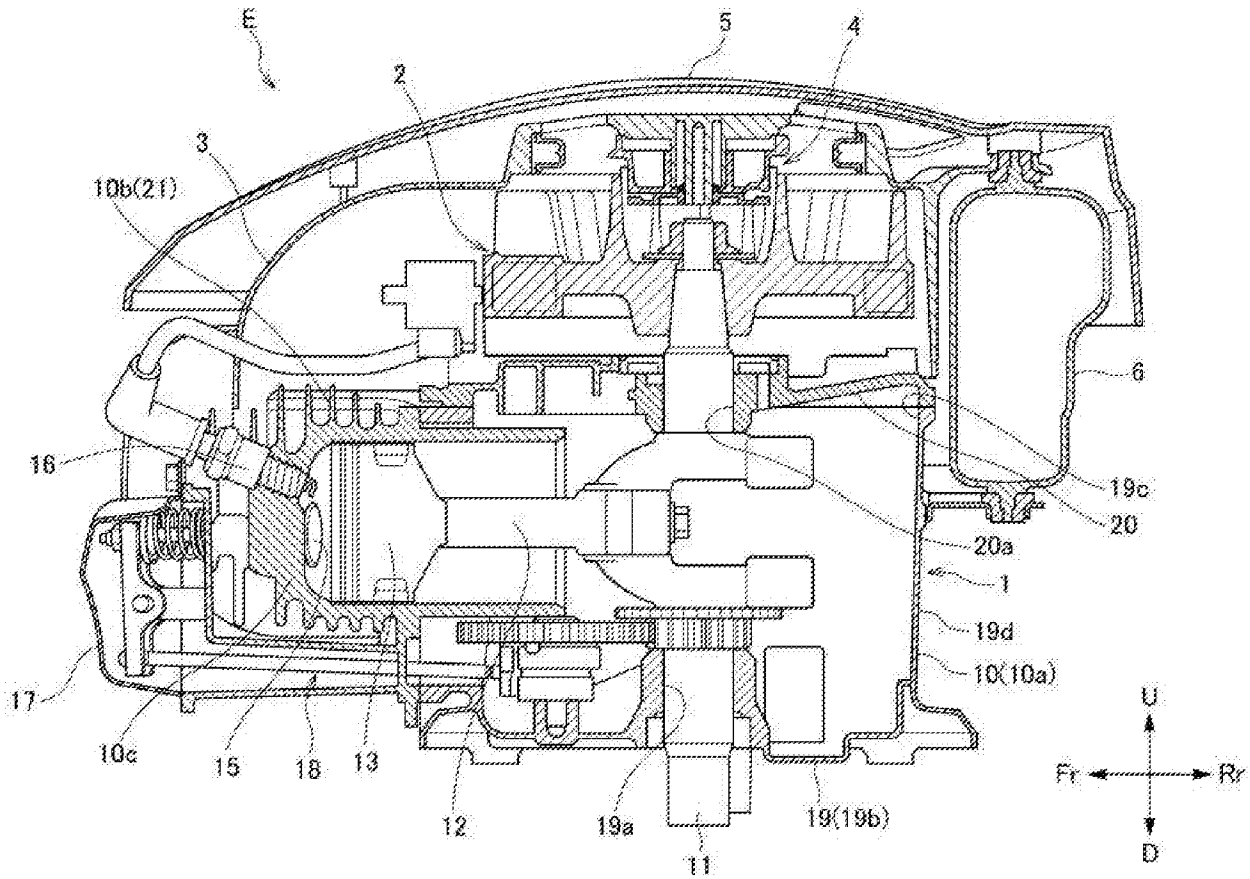
FIG. 1 is a sectional view of an engine according to an embodiment of the present invention.
Figure 2:
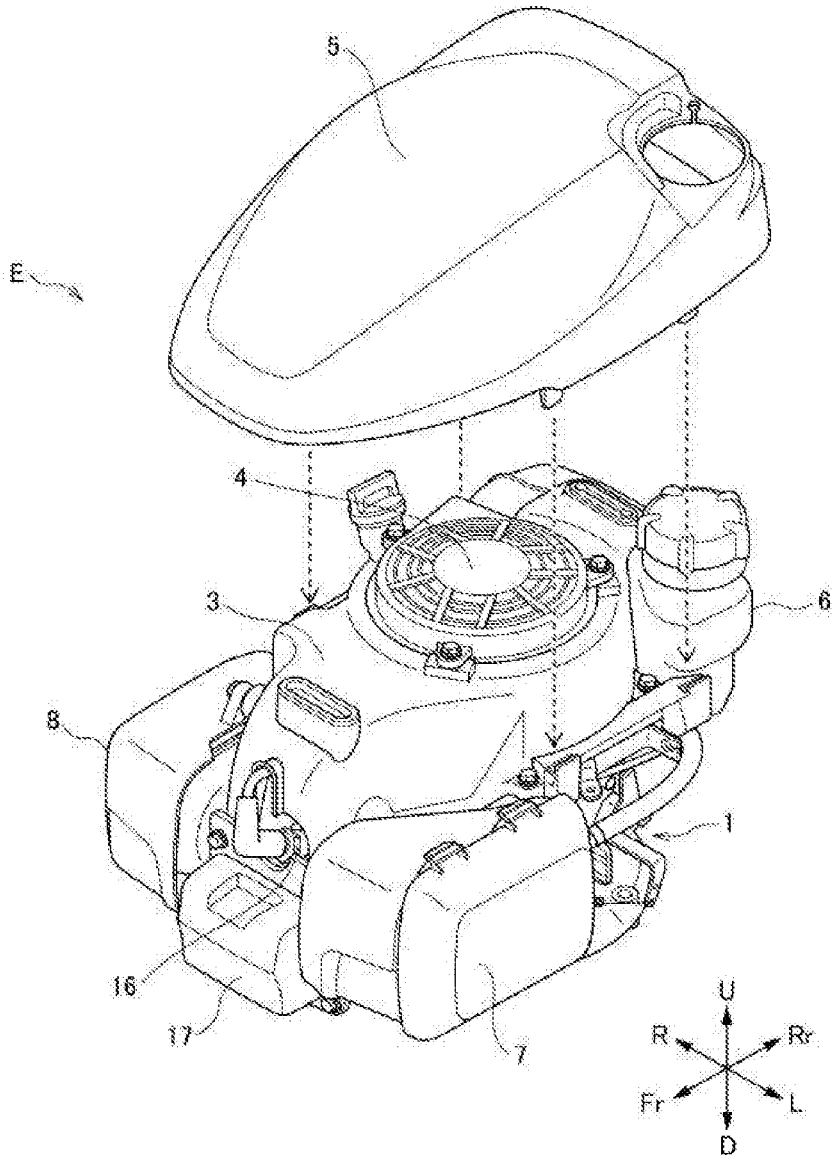
FIG. 2 is a perspective view of the engine with a top cover removed, as viewed from an obliquely front and upper side.
Figure 3:
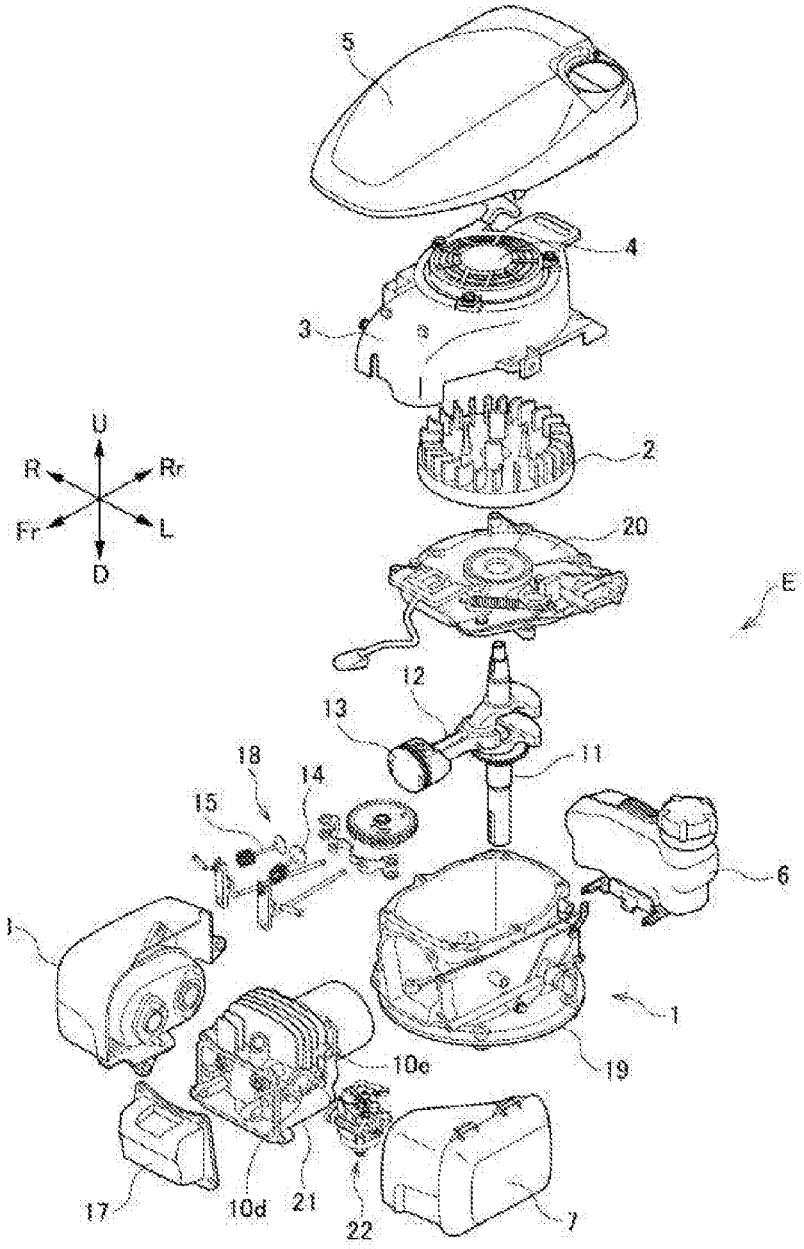
FIG. 3 is an exploded perspective view of the engine as viewed from the oblique front and upper side.

Hereinafter, an embodiment of the present invention will be described with reference to FIGS. 1 to 9E. An engine E of the present embodiment is a small-sized general-purpose engine mounted on a walk-behind lawn mower or the like, and includes an OHV vertical engine as an engine main body 1. In the present specification or the like, in order to simplify and clarify the description, an axial center direction of a crankshaft 11 is defined as an upper-lower direction, a direction in which a piston 13 slides back and forth is defined as a front-rear direction, which is orthogonal to the upper-lower direction, and a direction orthogonal to the upper-lower direction and the front-rear direction is defined as a left-right direction. In the drawings, a front side of the engine E is shown as Fr, a rear side thereof is shown as Rr, a left side thereof is shown as L, a right side thereof is shown as R, an upper side thereof is shown as U, and a lower side thereof is shown as D.

[Engine]

As shown in FIGS. 1 to 5, the engine E of the present embodiment includes the engine main body 1, a fan 2 for cooling that is arranged above the engine main body 1 and also functions as a flywheel, a fan cover 3 that accommodates the fan 2, a recoil starter 4 that is arranged above the fan 2 and performs a starting operation of the engine main body 1, a top cover 5 that covers at least upper portions of the engine main body 1, the fan 2, the fan cover 3, and the recoil starter 4, a fuel tank 6 that stores fuel in the engine main body 1, an air cleaner 7 that purifies intake air from the engine main body 1, and a muffler 8 that exhausts exhaust gas of the engine main body 1 while muffling the exhaust gas.

[Engine Main Body]

The engine main body 1 includes an engine block 10 having a crankcase portion 10*a* and a cylinder portion 10*b*, the crankshaft 11 that is rotatably supported by the crankcase portion 10*a* in an upper-lower direction, the piston 13 that is slidably fitted in the cylinder portion 10*b* and connected to the crankshaft 11 via a connecting rod 12, an intake valve 14 that is provided on a head portion 10*c* of the cylinder portion 10*b*, an exhaust valve 15, a spark plug 16, a head cover 17 that covers the head portion 10*c* of the cylinder portion 10*b*, a valve-operating mechanism 18 that operates the intake valve 14 and the exhaust valve 15 in accordance with a rotation of the crankshaft 11, a carburetor 22 that generates an air-fuel mixture of fuel and air and supplies the air-fuel mixture into the cylinder portion 10*b*, a governor device 23 that automatically opens and closes a throttle valve (not shown) of the carburetor 22 in accordance with a rotational speed (the number of rotations) of the crankshaft 11, and an automatic choke device 25 that automatically opens and closes a choke valve 24 of the carburetor 22 in accordance with a change in the temperature of the engine main body 1.

The engine block 10 of the present embodiment is divided into three parts including a crankcase main body 19 that includes a bottom portion 19*b* having a first crankshaft insertion hole 19*a*, and a tubular portion 19*d* in which the bottom portion 19*b* is integrally formed at a lower end portion thereof and a case opening portion 19*c* is provided at an upper end portion thereof, a crankcase cover 20 that has a second crankshaft insertion hole 20*a*, and covers the case opening portion 19*c* of the crankcase main body 19, and a cylinder unit 21 that extends forward from the tubular portion 19*d* of the crankcase main body 19. In addition, the crankcase main body 19 and the crankcase cover 20 configure the crankcase portion 10*a*, and the cylinder unit 21 configures the cylinder portion 10*b*, but a configuration of the engine block 10 is not limited to that of the present embodiment, and can be changed as appropriate.

[Carburetor]

Figure 4:
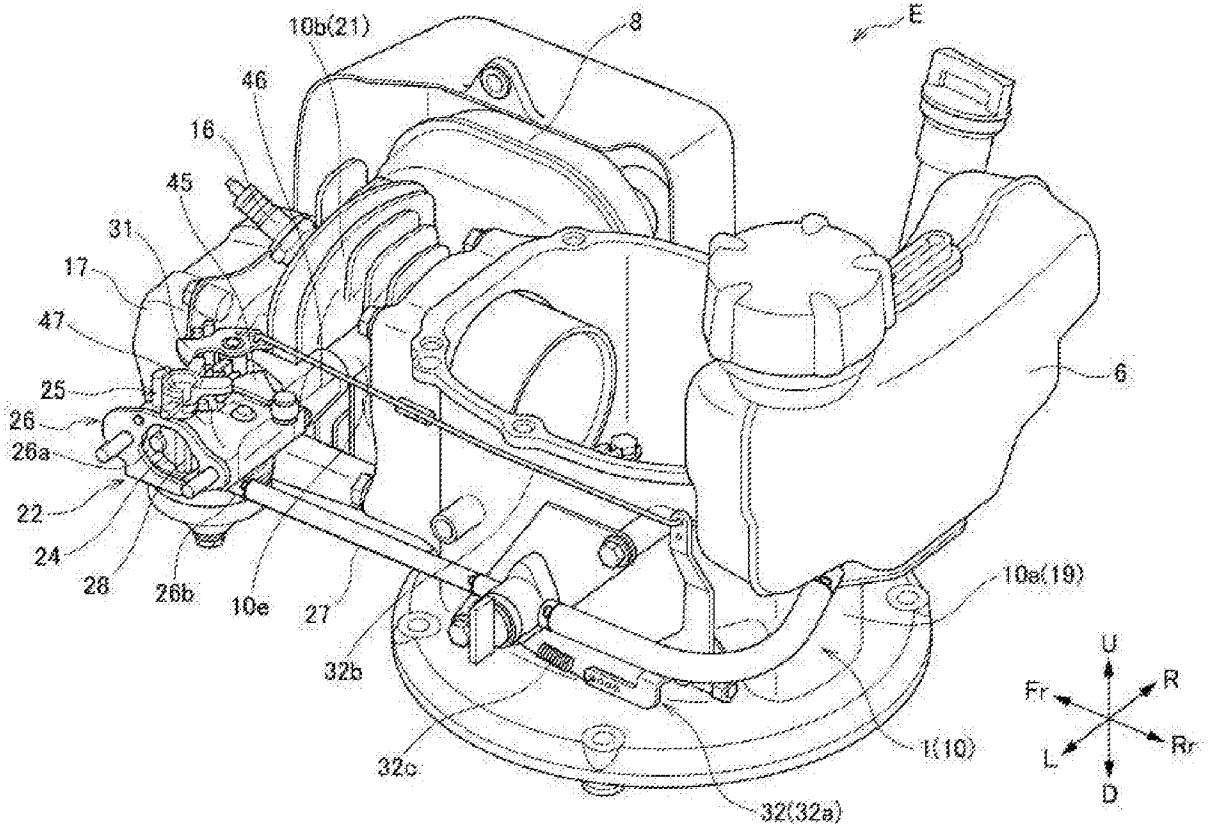
FIG. 4 is a perspective view of the engine with a crankcase cover or the like removed, as viewed from an obliquely rear and upper side.
Figure 6:
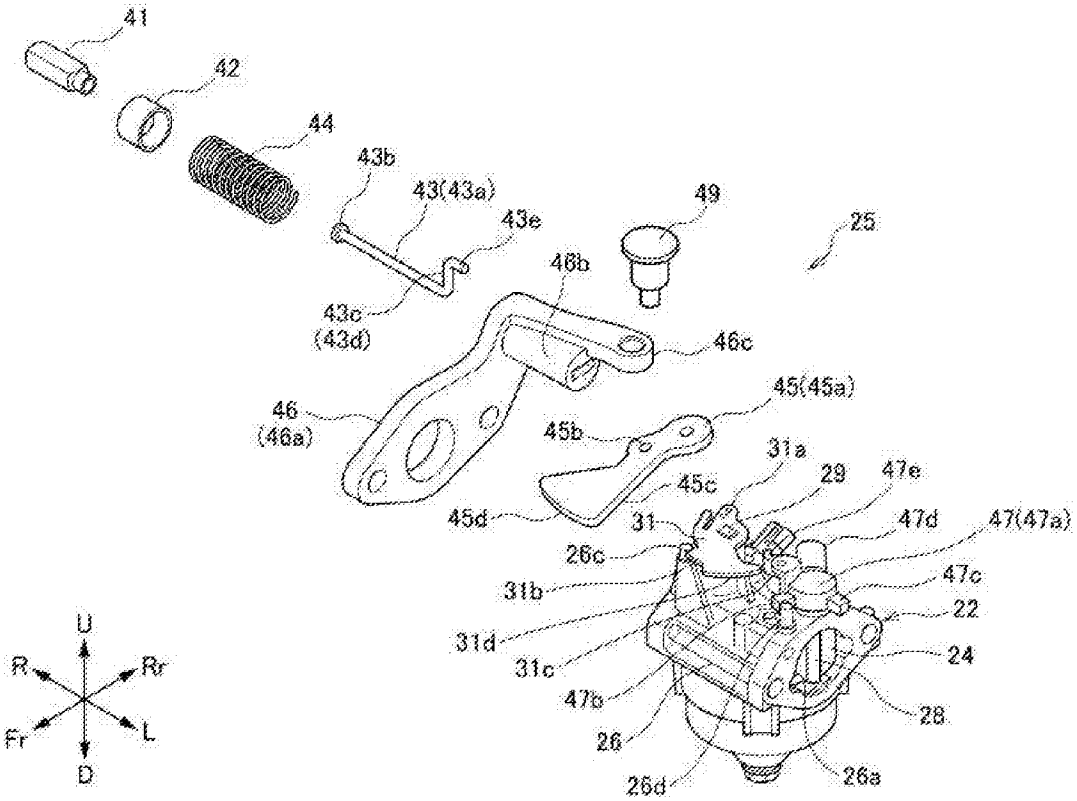
FIG. 6 is an exploded perspective view of an automatic choke device.

As shown in FIGS. 4 and 6, the carburetor 22 includes a carburetor main body 26 having an intake passage 26*a* penetrating in the left-right direction, the choke valve 24 arranged on an upstream side of the intake passage 26*a*, and the throttle valve (not shown) arranged on a downstream side of the intake passage 26*a*.

The carburetor main body 26 is attached to the cylinder portion 10*b* of the engine main body 1 such that a downstream side opening portion of the intake passage 26*a* communicates with an intake port 10*d* of the engine main body 1 (see FIG. 3), and an upstream side opening portion of the intake passage 26*a* is connected to the air cleaner 7. In addition, the carburetor main body 26 includes a fuel supply portion 26*b* to which fuel is supplied from the fuel tank 6 via a fuel tube 27, and the fuel supply portion 26*b* communicates with a fuel nozzle (not shown) that opens into the intake passage 26*a* between the choke valve 24 and the throttle valve. That is, in an intake stroke of the engine main body 1, the outside air is sucked into the intake passage 26*a* of the carburetor main body 26 through the air cleaner 7, the sucked air sucks out the fuel from the fuel nozzle to become the air-fuel mixture of air and fuel, and the air-fuel mixture is supplied to the cylinder portion 10*b* of the engine main body 1.

The choke valve 24 and the throttle valve are butterfly type valve bodies that are rotatably supported by the carburetor main body 26 via valve shafts 28, 29 extending in the upper-lower direction. The throttle valve is a valve for adjusting an amount of the air-fuel mixture to be supplied to the engine main body 1, is kept in a fully open position before the engine main body 1 is started, and is controlled to a closing side so as to maintain a predetermined engine speed by the governor device 23 when the engine main body 1 is started.

The choke valve 24 is a valve for adjusting a ratio of air and fuel in the air-fuel mixture. When the choke valve 24 is controlled to a closing side, the ratio of the fuel in the air-fuel mixture increases, and starting of the engine main body 1, particularly, starting at low temperature is facilitated. The choke valve 24 is connected to the automatic choke device 25 via the valve shaft 28, and an opening degree thereof is automatically controlled in accordance with the change in the temperature of the engine main body 1.

[Governor Device]

Figure 5:
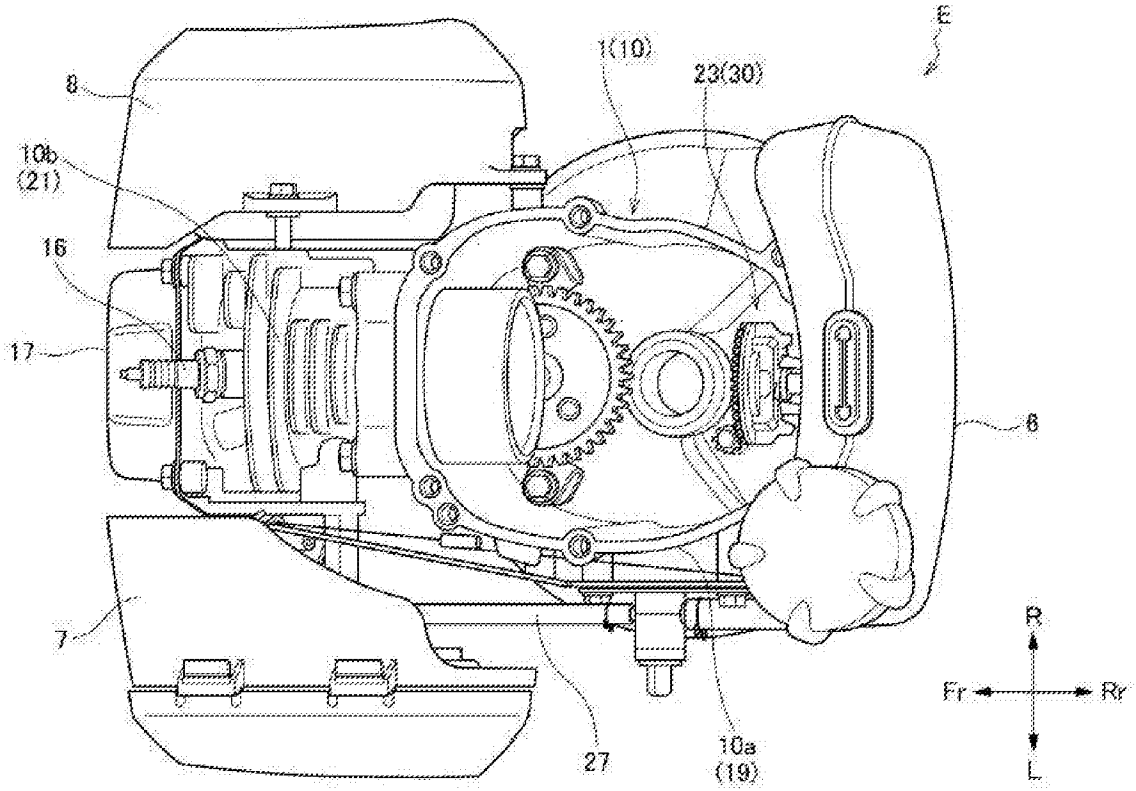
FIG. 5 is a plan view of the engine with the crankcase cover or the like removed.

As shown in FIGS. 4 and 5, the governor device 23 includes a rotational speed detection unit 30 that is arranged in the crankcase portion 10*a* of the engine main body 1 and detects the rotational speed (the number of rotations) of the crankshaft 11, a governor lever 31 that is integrally provided on an upper end portion of the valve shaft 29 of the throttle valve, and a rotational speed transmission portion 32 that takes out the rotational speed of the crankshaft 11 detected by the rotational speed detection portion 30 as a rotation change of an arm member 32*a* and transmits the rotational speed to the governor lever 31 via a rod member 32*b*.

The rod member 32*b* is connected to one end portion of the arm member 32*a*, is pulled rearward by an urging force of an arm return spring 32*c* connected to the other end portion of the arm member 32*a* when the engine is stopped, and is pushed forward in accordance with an increase in the rotational speed of the crankshaft 11 after the engine is started.

The rod member 32*b* is connected to one end portion 31*a* of the governor lever 31, and when the engine is stopped, the one end portion 31*a* is pulled rearward by the rod member 32*b* to rotate the valve shaft 29 in a direction in which the throttle valve opens. A governor stopper 26*c* for regulating a rotation of the governor lever 31 in an opening direction is provided in a protruding manner on an upper portion of the carburetor main body 26, and when the engine is stopped, a stopper engaging portion 31*b* of the governor lever 31 is engaged with the governor stopper 26*c* to keep the throttle valve in a fully open state. In addition, after the engine is started, the governor lever 31 pushes the one end portion 31*a* forward by the rod member 32*b* in accordance with the rotational speed of the crankshaft 11 to rotate the valve shaft 29 in a direction of closing the throttle valve, thereby maintaining a predetermined engine speed.

[Automatic Choke Device]

Figure 7:
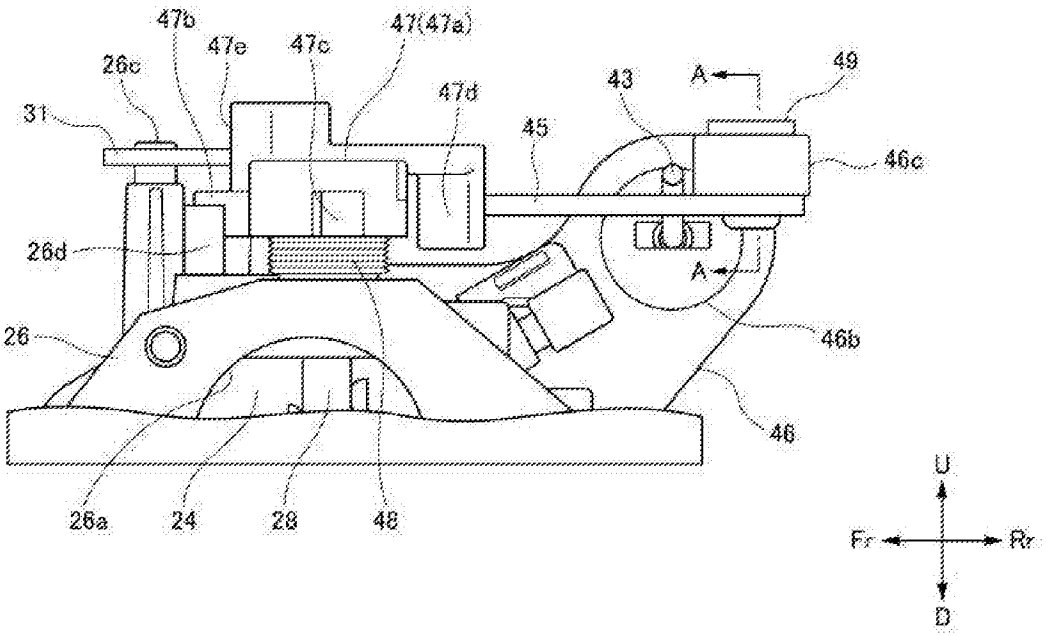
FIG. 7 is a side view of the automatic choke device.
Figure 8:
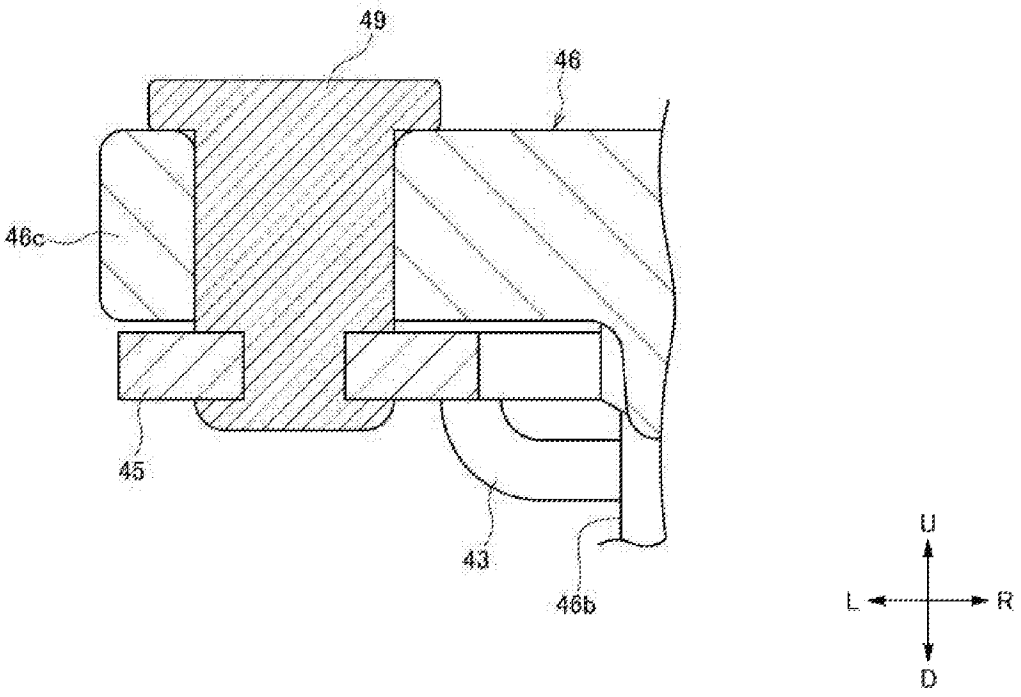
FIG. 8 is a sectional view taken along a line A-A in FIG. 7.

As shown in FIGS. 6 to 8, the automatic choke device 25 includes a wax 41 that is attached to the engine main body 1, a rod 43 that is connected to the wax 41 via a retainer 42 and performs a linear motion (jumping operation) in conjunction with thermal expansion of the wax 41, a rod return spring 44 that pushes back the retainer 42 and the rod 43 in conjunction with thermal contraction of the wax 41, a choke lever 45 that rotates in conjunction with the linear motion of the rod 43, a holding member 46 that supports the rod 43 and the choke lever 45, a choke shaft 47 that is arranged so as to be able to abut against the choke lever 45 and connected to the choke valve 24 of the carburetor 22, and a shaft return spring 48 that urges the choke shaft 47 in the direction of closing the choke valve 24.

That is, the automatic choke device 25 of the present embodiment includes the wax 41 that thermally expands in accordance with temperature rise of the engine main body 1. When the engine is stopped (when the engine temperature is low), the choke valve 24 of the carburetor 22 is maintained on the closing side to facilitate the starting of the engine main body 1, while after the engine is started, the choke valve 24 of the carburetor 22 is controlled to an opening side by the thermal expansion of the wax 41 in accordance with the temperature rise of the engine main body 1. However, in the automatic choke device 25, since overstroke occurs in which the wax 41 continues the thermal expansion even after the choke valve 24 is fully opened, it is necessary to absorb the overstroke of the wax 41. Hereinafter, a configuration of each portion of the automatic choke device 25 will be described with reference to FIGS. 6 to 8.

(Wax)

The wax 41 is a heat-sensitive actuator that encloses a heat-sensitive material whose volume changes in accordance with a change in the temperature, expands and contracts in accordance with a change in the volume of the heat-sensitive material, and is configured to thermally expand in a length direction as the temperature rises and thermally contract in the length direction as the temperature falls. The wax 41 of the present embodiment is arranged at a side surface of the cylinder portion 10*b* of the engine main body 1, that is, closer the crankcase portion 10*a* side than the intake port 10*d*, avoiding a position in the vicinity of the intake port 10*d* (see FIG. 3). Specifically, a tubular portion 10*e* is provided in a protruding manner on a side surface of the cylinder portion 10*b* of the engine main body 1, and the wax 41 is accommodated in the tubular portion 10*e*.

That is, in the vicinity of the intake port 10*d*, due to latent heat of vaporization of the fuel, the temperature of the wax 41 may deviate from a temperature in a combustion chamber at the time of soaking after the engine is stopped, but a temperature rise characteristic of the wax 41 can be made close to a temperature characteristic of the combustion chamber by arranging the wax 41 on the side surface of the cylinder portion 10*b* of the engine main body 1, that is, at a position separated from the intake port 10*d*.

(Holding Member)

The holding member 46 integrally includes an attachment portion 46*a* that is attached to the engine main body 1, a tubular rod support portion 46*b* that supports the rod 43 so as to be movable in the left-right direction, and a choke lever support portion 46*c* that rotatably supports the choke lever 45 via a pin 49. According to such a holding member 46, the number of components can be reduced as compared with a case where a holding member for supporting the rod 43 that performs a linear motion and a holding member for supporting the choke lever 45 that performs a rotating motion are separately provided.

When the carburetor 22 is attached to the engine main body 1, the attachment portion 46*a* of the holding member 46 is sandwiched between the carburetor 22 and the engine main body 1, and is fixed and fastened together with the carburetor 22 and the engine main body 1 by a bolt (not shown) that fastens the carburetor 22 to the engine main body 1. According to the attachment portion 46*a* of the holding member 46, the number of components can be reduced as compared with a case of being fixed to the engine main body 1 with a dedicated bolt.

(Rod)

The rod 43 integrally includes a rod main body 43*a* that is supported by the rod support portion 46*h* of the holding member 46 so as to be movable in the left-right direction, a retainer connecting portion 43*b* that is provided at a base end portion of the rod main body 43*a* and is connected to the retainer 42, and a choke lever connecting portion 43*c* that is provided at a distal end portion of the rod main body 43*a* and connected to the choke lever 45.

The choke lever connecting portion 43*c* includes an upward extending portion 43*d* that extends upward from a distal end of the rod main body 43*a* and is inserted into a rod connecting hole 45*b* of the choke lever 45 to interlock the choke lever 45 with a linear motion of the rod 43 in a pushing direction and a pulling direction, and a coming-off prevention portion 43*e* that extends outward from an upper end of the upward extending portion 43*d* and prevents the upward extending portion 43*d* from coming off.

(Choke Lever)

The choke lever 45 includes a choke lever main body 45*a* that is rotatably supported by the choke lever support portion 46*c* of the holding member 46 via the pin 49, a rod connecting hole 45*b* that is formed in the vicinity of a rotation center (pin 49) of the choke lever main body 45*a* and is connected to the rod 43, a flat portion 45*c* that engages with a choke lever engaging portion 47*d* of the choke shaft 47, and a circular arc portion 45*d* that is formed in a circular arc shape so as to be continuous (a circular arc shape with a rotation center of the choke lever 45 as a circular arc center) from the flat portion 45*c* and is brought into sliding contact with the choke lever engaging portion 47*d* of the choke shaft 47.

According to such a choke lever 45, one choke lever 45 can be substituted for an automatic choke operation performed by two lever members and one connecting spring in an automatic choke device in the related art, so that the number of components can be reduced.

That is, during warming up of the engine main body 1, the flat portion 45*c* of the choke lever 45 engages with the choke lever engaging portion 47*d* of the choke shaft 47 to rotate the choke shaft 47, so that the choke valve 24 can be opened in conjunction with the expansion of the wax 41. On the other hand, after the choke valve 24 is fully opened, the circular arc portion 45*d* of the choke lever 45 is brought into sliding contact with the choke lever engaging portion 47*d* of the choke shaft 47, so that the overstroke of the wax 41 can be absorbed without rotating the choke shaft 47.

Since the circular arc portion 45*d* of the choke lever 45 is brought into sliding contact with the choke lever engaging portion 47*d* of the choke shaft 47 and absorbs the overstroke of the wax 41, rigidity of each member can be reduced as compared with a case where the overstroke of the wax 41 is received by a connecting spring as in the related art.

The choke lever 45 of the present embodiment is a plate-shaped member, and the flat portion 45*c* and the circular arc portion 45*d* are provided on a side surface of the plate-shaped member. According to such a choke lever 45, the choke lever 45 can be reduced in a size by setting the flat portion 45*c* and the circular arc portion 45*d* of the choke lever 45 on the side surface of the plate-shaped member having high rigidity.

(Choke Shaft)

The choke shaft 47 includes a choke shaft main body 47*a* that is integrally provided on an upper end portion of the valve shaft 28 of the choke valve 24 and is urged by the shaft return spring 48 in a direction of closing the choke valve 24, a first stopper engaging portion 47*b* and a second stopper engaging portion 47*c* that extend in an outer diameter direction from the choke shaft main body 47*a* and engages with a choke stopper 26*d* provided in a protruding manner on the upper portion of the carburetor main body 26 to regulate a rotation range of the choke shaft 47, a choke lever engaging portion 47*d* that extends in the outer diameter direction from the choke shaft main body 47*a* and engages or is brought into sliding contact with the choke lever 45, and a governor lever engaging portion 47*e* that extends in the outer diameter direction from the choke shaft main body 47*a* and engages with the governor lever 31.

The first stopper engaging portion 47*b* engages with the choke stopper 26*d* at a position at which the choke valve 24 is in a fully closed state so as to regulate the rotation of the choke shaft 47 in the direction of closing the choke valve 24. In addition, the second stopper engaging portion 47*c* engages with the choke stopper 26*d* at a position at which the choke valve 24 is in the fully open state so as to regulate the rotation of the choke shaft 47 in a direction of opening the choke valve 24.

During warming up of the engine main body 1, the choke lever engaging portion 47*d* is pushed by the flat portion 45*c* of the choke lever 45 to rotate the choke shaft 47, thereby opening the choke valve 24 in conjunction with the expansion of the wax 41. On the other hand, after the choke valve 24 is fully opened, the choke lever engaging portion 47*d* is brought into sliding contact with the circular arc portion 45*d* of the choke lever 45, so that the overstroke of the wax 41 is absorbed without rotating the choke shaft 47.

Immediately after starting the engine main body 1 and during warming up, the governor lever engaging portion 47*e* is pushed by the other end portion 31*c* of the governor lever 31 that controls a slot valve of the carburetor 22 in the closing direction in accordance with the rotation of the crankshaft 11 to rotate the choke shaft 47, so that the choke valve 24 is slightly opened, and appropriate intake air can be taken even before the wax 41 expands. Incidentally, the governor lever 31 includes a circular arc portion 31*d* that is formed in a circular arc shape so as to be continuous from the other end portion 31*c* that pushes the governor lever engaging portion 47*e* (a circular arc shape with a rotation center of the governor lever 31 as a circular arc center), and is brought into sliding contact with the governor lever engaging portion 47*e* of the Choke shaft 47. After the other end portion 31*c* of the governor lever 31 pushes the governor lever engaging portion 47*e* to open the choke valve 24 by a predetermined amount, the circular arc portion 31*d* is brought into sliding contact with the governor lever engaging portion 47*e* to maintain the opening degree of the choke valve 24.

In the present embodiment, when arranging the governor lever 31 and the choke lever 45 on the upper surface portion of the carburetor 22, the governor lever 31 and the choke lever 45 are arranged at positions different in a distance from the upper surface of the carburetor 22, and a rotation area of the governor lever 31 and a rotation area of the choke lever 45 overlap each other. According to this arrangement, the automatic choke device 25 can be reduced in the size.

[Operation of Automatic Choke Device]

Next, the operation of the automatic choke device 25 will be described with reference to FIGS. 9A, 9B, 9C, 9D, and 9E.

Figures 9A, 9B, 9C, 9D, 9E:
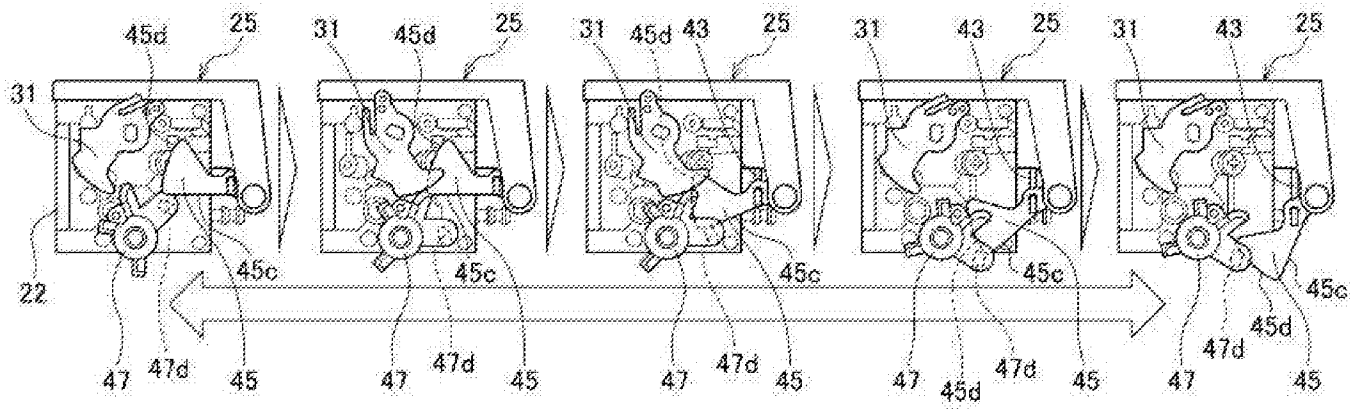

As shown in FIG. 9A, since the wax 41 is in a contracted state when the engine is stopped (cold state), the choke lever 45 is maintained at an initial position where the choke lever 45 does not engage with the choke lever engaging portion 47*d* of the choke shaft 47 due to an urging force of the rod return spring 44. In addition, the choke shaft 47 is maintained at an initial position where the choke valve 24 is in the fully closed state by the urging force of the shaft return spring 48. The governor lever 31 is maintained at an initial position where the throttle valve is in the fully open state by the urging force of the arm return spring 32*c*.

As shown in FIG. 9B, since the wax 41 is in the contracted state immediately after the engine is started, the choke lever 45 maintains the initial position, but the governor lever 31 is rotated in accordance with the rotation of the crankshaft 11 so as to rotate the choke shaft 47, so that the choke valve 24 is slightly opened, the appropriate intake air can be taken even before the wax 41 expands. Further, in this state, the ratio of the fuel in the air-fuel mixture sucked from the carburetor 22 to the cylinder portion 10*b* of the engine main body 1 is increased, so that the starting of engine main body 1 is facilitated.

As shown in FIG. 9C, since the wax 41 thermally expands when the engine is warming up, the choke lever 45 advances from the initial position in accordance with the temperature rise of the engine main body 1, and the flat portion 45*c* of the choke lever 45 engages with the choke lever engaging portion 47*d* of the choke shaft 47 to rotate the choke shaft 47. As a result, the choke valve 24 is opened in conjunction with the expansion of the wax 41, and the ratio of the fuel in the air-fuel mixture sucked from the carburetor 22 to the cylinder portion 10*b* of the engine main body 1 is gradually lowered.

As shown in FIG. 9D, when the choke valve 24 is fully opened, an engaging position between the flat portion 45*c* of the choke lever 45 and the choke lever engaging portion 47*d* of the choke shaft 47 reaches an engaging range end position of the flat portion 45*c*, that is, a sliding contact range start position of the circular arc portion 45*d*.

As shown in FIG. 9E, in the overstroke state of the wax 41, the circular arc portion 45*d* of the choke lever 45 is brought into sliding contact with the choke lever engaging portion 47*d* of the choke shaft 47, so that the overstroke of the wax 41 can be absorbed without rotating the choke shaft 47.

The above embodiment may be appropriately modified, improved, or the like. For example, in the embodiment described above, the automatic choke device of a carburetor applied to the OHV vertical engine has been described, but the automatic choke device of a carburetor of the present invention can also be applied to engines other than the OHV vertical engine.

At least the following matters are described in the present specification. Components corresponding to the above-described embodiment are shown in parentheses, but the present invention is not limited thereto.

(1) An automatic choke device of a carburetor including:

a wax (wax 41) attached to an engine main body (engine main body 1);

a rod (rod 43) configured to perform a linear motion in conjunction with expansion of the wax;

a choke lever (choke lever 45) configured to rotate in conjunction with the linear motion of the rod; and a choke shaft (choke shaft 47) arranged so as to be able to abut against the choke lever and connected to a choke valve (choke valve 24) of the carburetor (carburetor 22), wherein the choke lever includes a flat portion (flat portion 45*c*) that engages with an engaging portion (choke lever engaging portion 47*d*) of the choke shaft, and a circular arc portion (circular arc portion 45*d*) that is formed in a circular arc shape so as to be continuous from the flat portion and is brought into sliding contact with the engaging portion of the choke shaft.

According to (1), since one choke lever can be substituted for an automatic choke operation performed by two lever members and one connecting spring in an automatic choke device in the related art, the number of components can be reduced.

That is, during warming up of an engine, the choke valve can be opened in conjunction with expansion of the wax by engaging the flat portion of the choke lever with the engaging portion of the choke shaft. On the other hand, after the choke valve is fully opened, the circular arc portion of the choke lever is brought into sliding contact with the engaging portion of the choke shaft, so that the overstroke of the wax can be absorbed.

In addition, since the circular arc portion of the choke lever is brought into sliding contact with the engaging portion of the choke shaft and absorbs the overstroke of the wax, rigidity of each member can be reduced as compared with the case where the overstroke of the wax is received by a connecting spring as in the related art.

(2) The automatic choke device of a carburetor according to (1), wherein the choke lever is a plate-shaped member, and wherein the flat portion and the circular arc portion are provided on a side surface of the plate-shaped member.

According to (2), the choke lever can be reduced in a size by setting the flat portion and the circular arc portion of the choke lever on the side surface of the plate-shaped member having high rigidity.

(3) The automatic choke device of a carburetor according to (1) or (2), wherein the rod and the choke lever are supported by a holding member (holding member 46) attached to the engine main body.

According to (3), the number of components can be reduced by supporting the rod that performs a linear motion and the choke lever that performs a rotating motion by the holding member attached to the engine main body.

(4) The automatic choke device of a carburetor according to any one of (1) to (3), wherein the choke shaft is capable of abutting against a governor lever (governor lever 31) connected to a throttle valve of the carburetor.

According to (4), the choke shaft is slightly opened in conjunction with a governor immediately after the engine is started, so that appropriate intake air can be taken before the wax expands.

(5) The automatic choke device of a carburetor according to (4), wherein the governor lever and the choke lever are arranged at positions different in a distance from a wall surface of the carburetor, and wherein a rotation area of the governor lever and a rotation area of the choke lever overlap each other.

According to (5), the governor lever and the choke lever are arranged at the positions different in the distance from the wall surface of the carburetor, and the rotation area of the governor lever and the rotation area of the choke lever overlap each other, so that the automatic choke device can be reduced in the size.

(6) The automatic choke device of a carburetor according to any one of (1) to (5), wherein the wax is arranged on a side surface of a cylinder portion (cylinder portion 10*b*) of the engine main body.

According to (6), in the vicinity of the intake port, due to the latent heat of vaporization of fuel, a temperature of the wax may deviate from a temperature in a combustion chamber at the time of soaking after the engine is stopped, but a temperature rise characteristic of the wax can be made close to a temperature characteristic of the combustion chamber by arranging the wax on a side surface of the cylinder portion of the engine main body.

REFERENCE SIGNS LIST

1 engine main body
10*b* cylinder portion
22 carburetor
24 choke valve
25 automatic choke device
31 governor lever
41 wax
43 rod
45 choke lever
45*c* flat portion
45*d* circular arc portion
46 holding member
47 choke shaft
47*d* choke lever engaging portion (engaging portion)

The invention claimed is:

1. An automatic choke device of a carburetor comprising:

a wax attached to an engine main body;

a rod configured to perform a linear motion in conjunction with expansion of the wax;

a choke lever configured to rotate in conjunction with the linear motion of the rod; and a choke shaft arranged so as to be able to abut against the choke lever and connected to a choke valve of the carburetor, wherein the choke lever includes a flat portion that engages with an engaging portion of the choke shaft, and a circular arc portion that is formed in a circular arc shape so as to be continuous from the flat portion and is brought into sliding contact with the engaging portion of the choke shaft, the choke valve is opened in conjunction with the expansion of the wax by rotating the choke lever in a state where the flat portion of the choke lever engages with the engaging portion of the choke shaft, and after the choke valve is fully opened, an overstroke of the wax is absorbed without rotating the choke shaft by bringing the circular arc portion of the choke lever into sliding contact with the engaging portion of the choke shaft.

2. The automatic choke device of a carburetor according to claim 1, wherein the choke lever is a plate-shaped member, and wherein the flat portion and the circular arc portion are provided on a side surface of the plate-shaped member.

3. The automatic choke device of a carburetor according to claim 1, wherein the rod and the choke lever are supported by a holding member attached to the engine main body.

4. An automatic choke device of a carburetor comprising:

a wax attached to an engine main body;

a rod configured to perform a linear motion in conjunction with expansion of the wax;

a choke lever configured to rotate in conjunction with the linear motion of the rod; and a choke shaft arranged so as to be able to abut against the choke lever and connected to a choke valve of the carburetor, wherein the choke lever includes a flat portion that engages with an engaging portion of the choke shaft, and a circular arc portion that is formed in a circular arc shape so as to be continuous from the flat portion and is brought into sliding contact with the engaging portion of the choke shaft, and wherein the choke shaft is capable of abutting against a governor lever connected to a throttle valve of the carburetor.

5. The automatic choke device of a carburetor according to claim 4, wherein the governor lever and the choke lever are arranged at positions different in a distance from a wall surface of the carburetor, and wherein a rotation area of the governor lever and a rotation area of the choke lever overlap each other.

6. The automatic choke device of a carburetor according to claim 1, wherein the wax is arranged on a side surface of a cylinder portion of the engine main body.

* * * * *